US012643647B2

(12) United States Patent
Ho

(10) Patent No.: US 12,643,647 B2
(45) Date of Patent: Jun. 2, 2026

(54) DETACHABLE MOTOR ASSEMBLY AND COMMUNICATION MODULE

(71) Applicant: ZHONGSHAN YATAI ELECTRIC APPLIANCES CO., LTD., Guangdong (CN)

(72) Inventor: Kei Kun Ho, Macau (CN)

(73) Assignee: ZHONGSHAN YATAI ELECTRIC APPLIANCES CO., LTD., Guangdong (CN)

( * ) Notice: Subject to any disclaimer, the term of this patent is extended or adjusted under 35 U.S.C. 154(b) by 370 days.

(21) Appl. No.: 18/390,828

(22) Filed: Dec. 20, 2023

(65) Prior Publication Data

US 2025/0206428 A1 Jun. 26, 2025

(51) Int. Cl.

| | |
|---|---|
| ***B63H 20/12*** | (2006.01) |
| ***B63H 20/00*** | (2006.01) |
| ***B63H 20/06*** | (2006.01) |
| ***B63H 20/14*** | (2006.01) |
| ***B63H 20/32*** | (2006.01) |

(52) U.S. Cl.
CPC ..... *B63H 20/12* (2013.01); *B63H 20/007* (2013.01); *B63H 20/06* (2013.01); *B63H 20/14* (2013.01); *B63H 20/32* (2013.01)

(58) Field of Classification Search
CPC ..... B63H 20/12; B63H 20/007; B63H 20/06; B63H 20/14; B63H 20/32; B63B 34/26
See application file for complete search history.

(56) References Cited

U.S. PATENT DOCUMENTS 3,895,276 A * 7/1975 Brown ..... B63H 20/14 318/811
3,930,461 A * 1/1976 Brock ..... B63H 20/007 440/62
3,989,000 A * 11/1976 Foley, Jr. ..... B63H 23/34 440/58
4,021,873 A * 5/1977 Francois ..... B63B 1/041 114/123
4,610,632 A * 9/1986 Osborne ..... B63H 20/007 440/6
4,715,836 A * 12/1987 Schulte ..... B63H 20/12 440/58
4,729,745 A * 3/1988 Edwards ..... B63H 20/007 248/642
5,006,086 A * 4/1991 Latham ..... B63H 20/00 440/88 P (Continued)

FOREIGN PATENT DOCUMENTS

WO 95/286682 10/1995

*Primary Examiner* — Brian Christopher Delrue
(74) *Attorney, Agent, or Firm* — CHRISMAN GALLO TOCHTROP LLC

(57) ABSTRACT

A motor control system includes a housing and a mounting assembly. The housing includes a control module, a power motor, a steering motor, an electrification structure, and a communication structure. The housing is configured to be removably mounted within the mounting assembly. The communication structure includes a first signal line and a second signal line. The first signal line extends from the control module to the steering motor through a central portion of the communication structure. The second signal line extends from the control module to the power motor through the central portion of the communication structure.

15 Claims, 11 Drawing Sheets

(56) References Cited

U.S. PATENT DOCUMENTS 5,427,194 A * 6/1995 Miller ..... B60L 50/30 903/902
5,453,030 A * 9/1995 Broussard ..... B63H 20/007 114/144 R
6,431,923 B1 * 8/2002 Knight ..... B63H 25/42 440/6
7,452,251 B2 * 11/2008 Boebel ..... H02K 11/33 440/6
8,047,886 B1 * 11/2011 McLarty ..... B63B 34/10 441/67
9,296,455 B2 * 3/2016 Bernloehr ..... B63H 21/17
9,969,474 B1 * 5/2018 Truax ..... B63H 20/007
10,464,653 B2 * 11/2019 Anderson ..... B63H 20/007
10,723,428 B1 * 7/2020 Vicari ..... B63H 20/02
11,046,408 B1 * 6/2021 Crawford ..... B63B 34/05
11,180,226 B2 * 11/2021 Jensen ..... B63H 21/21
11,407,481 B1 * 8/2022 Oliverio ..... B63H 20/12
12,122,481 B2 * 10/2024 Montague ..... B63B 1/246
12,258,111 B1 * 3/2025 Berta, Jr. ..... B63H 20/06
12,325,500 B2 * 6/2025 Harshberger ..... B63H 21/17
2007/0222327 A1 * 9/2007 Li ..... H01R 39/38 310/90
2015/0298782 A1 * 10/2015 Bernloehr ..... B63H 20/007 440/6
2016/0016651 A1 * 1/2016 Anderson ..... G05D 1/0206 701/2
2020/0062365 A1 2/2020 Anderson et al.
2022/0332399 A1 * 10/2022 Cooper ..... B63H 25/10
2022/0380907 A1 * 12/2022 Raftegard ..... C23F 13/20
2023/0102255 A1 * 3/2023 Crawford ..... B63H 20/12 440/61 R
2023/0382508 A1 * 11/2023 Harshberger ..... B63H 23/24
2025/0229876 A1 * 7/2025 He ..... B63B 49/00
2026/0021881 A1 * 1/2026 Ambler ..... B63H 20/06

* cited by examiner

DETACHABLE MOTOR ASSEMBLY AND COMMUNICATION MODULE

BACKGROUND

Boats may be propelled and steered in a body of water either manually or by a machine. Traditionally, if a boat is propelled by a machine, it is propelled by a motor located at or near the back of the boat. The motor is typically a permanent fixture attached to the boat. The motor may be coupled with a means of steering the boat such as a rudder. The means of steering may be controlled manually or electronically. A control module may include a global positioning device (GPS) used to locate the position of the boat in the body of water and establish a direction and speed of travel. The control module may be coupled with the motor or means of steering.

BRIEF SUMMARY

According to one example of the present disclosure: a motor control assembly and a mounting system for a vessel comprise a system. The system includes at least one housing. The at least one housing includes a control module, a power motor, a steering motor, an electrification structure, and a communication structure. A mounting assembly allows for the at least one housing to be removably mounted within the mounting assembly. The communication structure includes a first signal line and a second signal line. The first signal line extends from the control module to the steering motor through a central portion of the communication structure. The second signal line extends from the control module to the power motor through the central portion of the communication structure.

DETAILED DESCRIPTION OF THE DRAWING

Considering the above, the present disclosure relates to a system including a detachable motor assembly for a vessel.

The motor assembly includes a power motor, a steering motor, a control module, and a communication structure. The steering motor and communication structure are located within a housing. The housing further includes a mounting structure that is used to removably mount the motor assembly to the vessel. The control module and power motor protrude from the housing. The communication structure is located between and communicates with the control module and the power motor, and further communicates with the steering motor.

Figure 1:
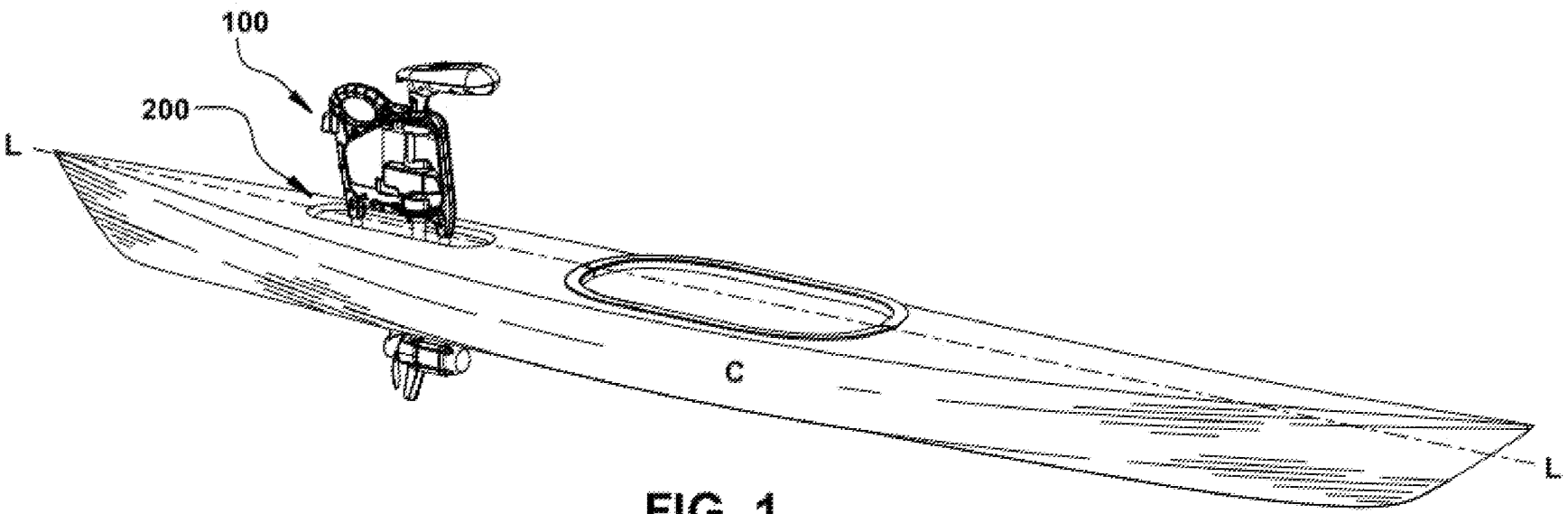
FIG. 1 illustrates a perspective view of a vessel including a detachable motor assembly.

According to the example of FIG. 1, a canoe C or other vessel includes a detachable motor assembly 100 and a mounting assembly 200. The canoe C is equipped with the mounting assembly 200 at an end of the canoe C. The mounting assembly 200 is located within a depth of the canoe C, however, it may extend upward above the top of the canoe C or below the bottom of the canoe C. The detachable motor assembly 100 is mounted to the canoe C by attaching to the mounting assembly 200. In an alternative embodiment, the canoe C may include more than one detachable motor assembly 100 and more than one mounting assembly 200. The detachable motor assembly 100 extends outwardly from the top of the canoe C, through the canoe C, and out the bottom of the canoe C. The detachable motor assembly 100 and the mounting assembly 200 are preferably aligned with a longitudinal axis L of the canoe C.

Figure 2:
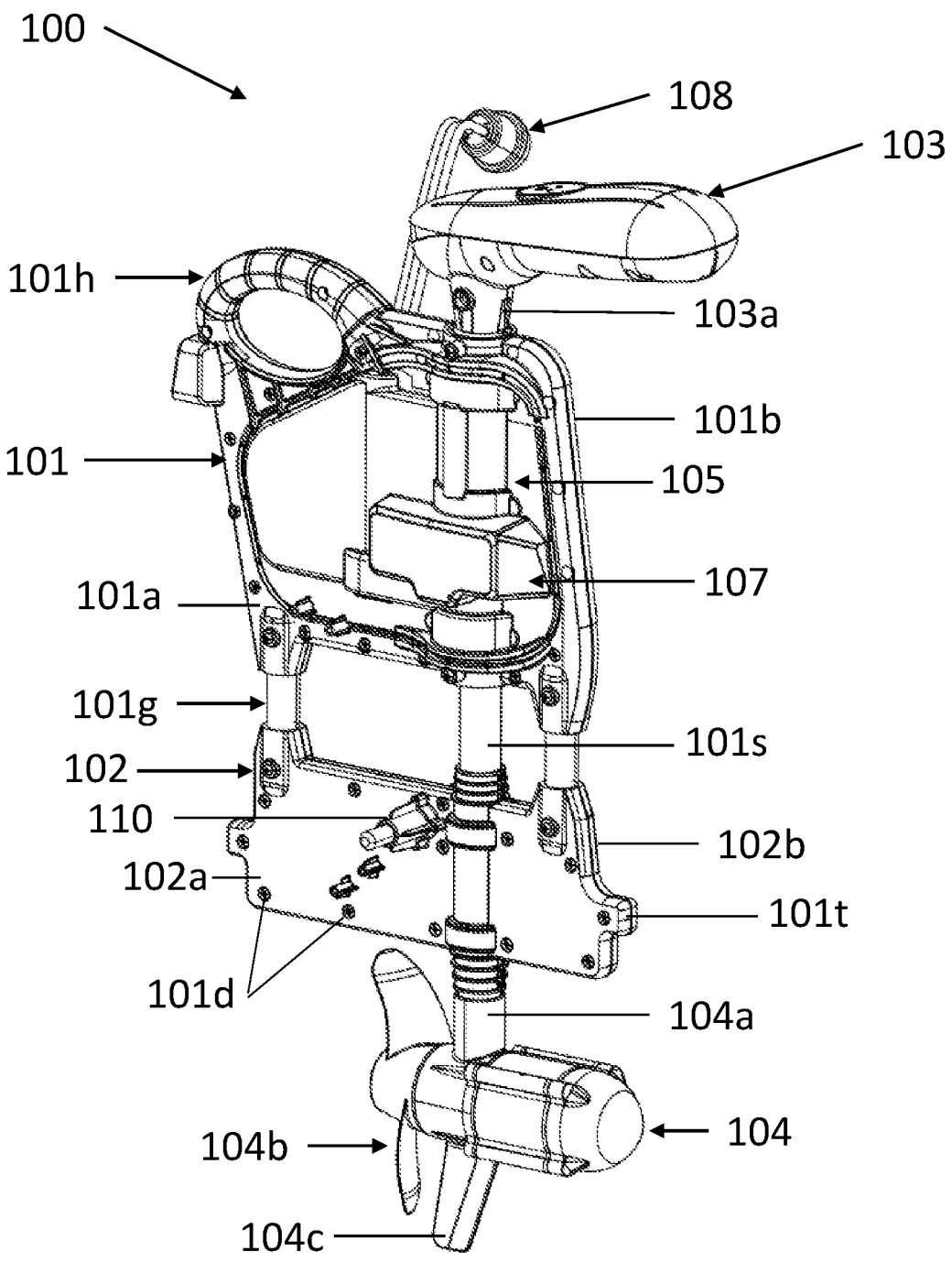
FIG. 2 illustrates a first side view of a first embodiment of a detachable motor assembly.

FIG. 2 depicts a first embodiment of the detachable motor assembly 100. The illustrated detachable motor assembly 100 includes an upper housing 101 and a lower housing 102. The upper housing 101 includes a first half shell 101*a* and a second half shell 101*b*. The lower housing 102 includes a first half shell 102*a* and a second half shell 102*b*. The first half shell 102*a* and the second half shell 102*b* of the lower housing 102 are joined together and form a second inner cavity.

Each half shell 101*a*, 101*b*, 102*a*, 102*b* is formed of a rigid material, the rigid material being, for example, plastic, metal, or a composite. The half shells 101*a*, 101*b*, 102*a*, 102*b* may be formed via injection molding, extrusion, or other casting process. The half shells 101*a*, 101*b*, 102*a*, 102*b* may be joined together by a plurality of fasteners 101*d*. The plurality of fasteners 101*d* may include screws, bolts, rivets, or similar fasteners.

The upper housing 101 and the lower housing 102 may be separated or spaced apart from one another by at least one support spacer 101*g*. The upper housing 101 includes an integrally formed assembly handle 101*h*. The assembly handle 101*h* provides a single point at which a user may grasp and lift the entire detachable motor assembly 100. The assembly handle 101*h* is formed of the same material that creates the half shells 101*a*, 101*b*, 102*a*, 102*b*. The assembly handle 101*h* may be located on the top of one of the housings 101, 102, or formed within one of the housings 101, 102.

A mounting rod 110 is located within and protrudes outwardly from the motor assembly 100. The mounting rod 110 may be located at the motor upper 101 or the lower housing 102. The mounting rod 110 is formed of a rigid material such as steel, aluminum, ceramics, etc. The mounting rod 110 is configured to support the motor assembly 100 in the mounting assembly 200. The upper housing 101 and/or the lower housing 102 may have additional support tabs 101*t* extending outwardly towards an inside of the canoe C. The additional support tabs 101*t* support some of the weight of the motor assembly 100 and prevent the motor assembly 100 from rocking, pivoting, or swiveling during use.

The detachable motor assembly 100 further includes a control module 103. The control module 103 includes a first support rod 103*a* that support the control module 103 and connects it to the motor assembly 100. The control module 103 may alternatively or additionally include various sensors such as accelerometers, gyroscopes, compasses, flow sensors, water sensors, altitude sensors, positioning sensors, and any other sensors used for navigation. Further, the control module 103 may include a GPS system. The control module 103 is configured to swivel around 360 degrees from its original position.

The detachable motor assembly 100 further includes a power motor 104. The power motor 104 includes a second support rod 104*a* that supports the power motor 104 and connects it to the motor assembly 100. The power motor 104 includes a propeller 104*b* and a rudder 104*c* for propelling and directing the canoe C, respectively. The rudder 104*c* extends from and is fixed to a bottom of the power motor 104. The propeller 104*b* extends from and is rotatably fixed to a back side of the power motor 104. A rotating shaft 101*s* extends from the control module 103 to the power motor 104.

A communication structure 105 is located within the upper housing 101 and makes up a portion of the rotating shaft 101*s*. The communication structure 105 connects the control module 103 and the power motor 104 to each other and to other elements within the motor assembly 100. Signals and power may be transmitted along and/or within the communication structure 105 to the elements within the motor housing 101. The structure of the communication structure 105 will be discussed further below.

An electrification structure 107 is located within the upper housing 101. The electrification structure 107 provides a positive power input to at least one element of the detachable motor assembly 100. The electrification structure 107 is axially aligned and concentric to the communication structure 105. The structure of the electrification structure 107 will be discussed further below.

A transmission handle 108 extends outwardly from a side of the upper housing 101. The transmission handle 108 is coupled to the motor assembly 100 and is configured to allow a user to manually adjust the power supplied to the power motor 104, the speed of the propeller 104*b*, and therefore the speed of the canoe C.

Figure 3:
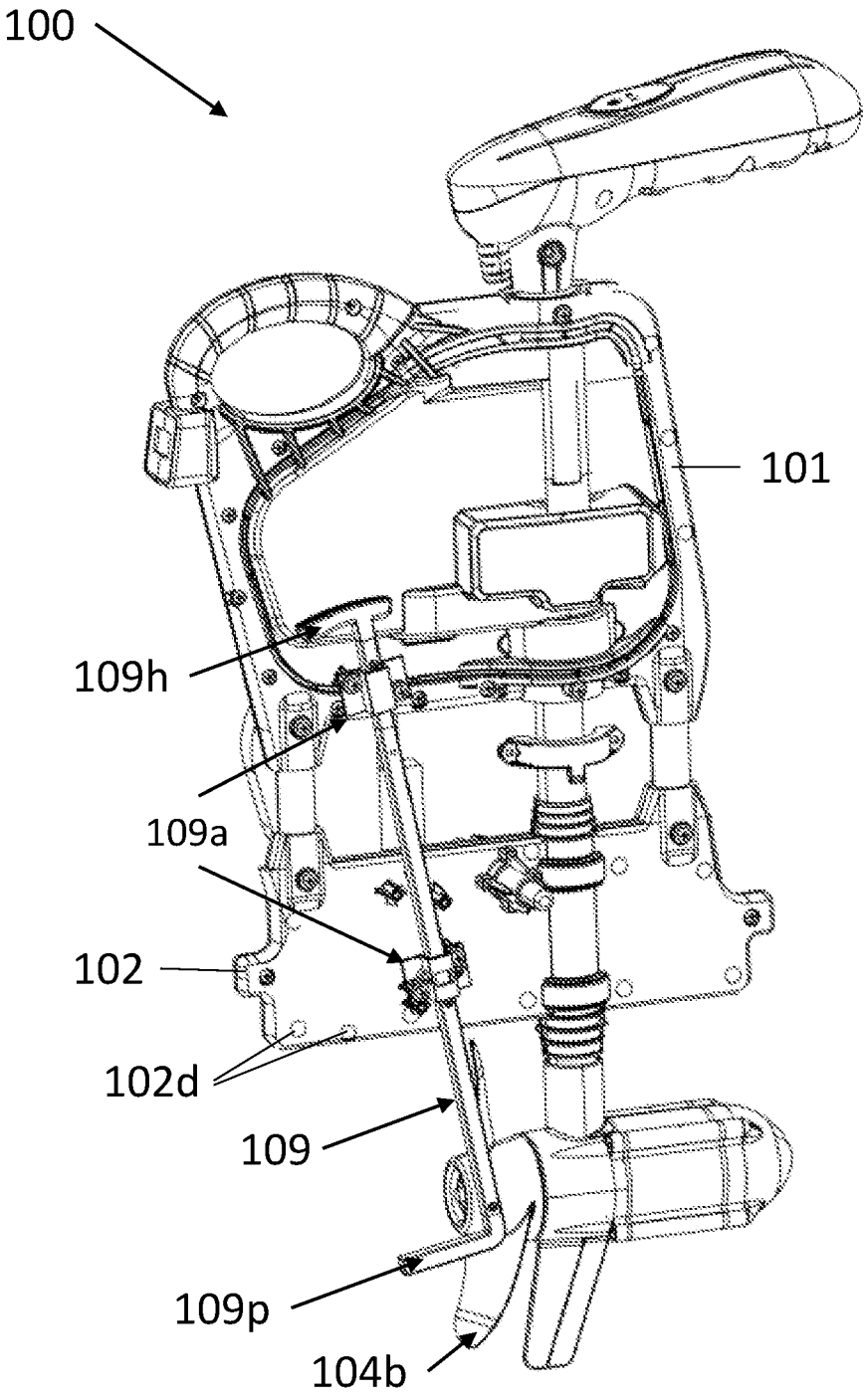
FIG. 3 illustrates a first side view of a second embodiment of a detachable motor assembly.

According to the example of FIG. 3, a stop lever 109 is located along a side of the upper housing 101 and the lower housing 102. The stop lever 109 has at least one attachment point 109*a* on the side of the upper housing 101 and/or the side of the lower housing 102. The at least one attachment point 109*a* may be, for example, a hollow sheath that is fixed to the upper housing 101 and allows for the passage and/or rotation of the stop lever 109 therethrough. The stop lever 109 further includes at least one stop handle 109*h* and at least one stop prong 109*p*. The stop prong 109*p* is configured to impede rotation of the propeller 104*b*, thereby preventing the propeller 104*b* from starting when the motor assembly 100 is removed from the vessel. The stop handle 109*b*, when pushed downwards by a user, moves the stop prong 109*p* within the path of the propeller 104*b* blades, thereby preventing the propeller 104*b* from spinning and causing damage to a user or itself.

The stop handle 109*b* is preferably made from or contains a magnetic material. When the stop handle 109*b* is in the highest position, the magnetic stop handle 109*b* triggers a magnetic induction switch located in the upper housing 101. When this magnetic induction switch is activated, the user is able to start the power motor 104. When the magnetic induction switch is not engaged, the user is unable to start the power motor 104.

As further illustrated in the example of FIG. 3, the plurality of fasteners 101*d* are received in fastening holes 102*d* located within each housing 101, 102.

Figure 4:
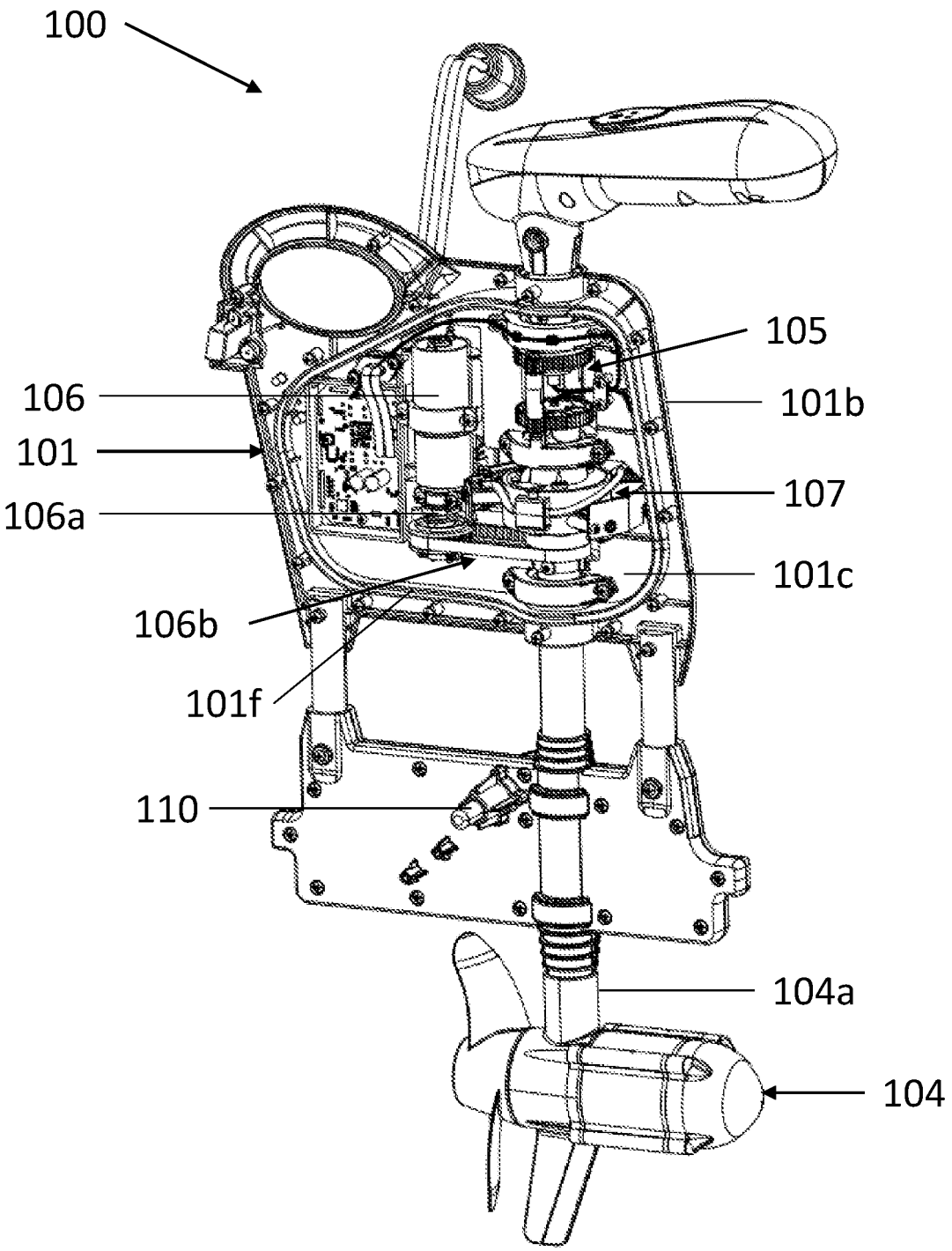
FIG. 4 illustrates a section view of the detachable motor assembly seen in FIG. 1.

FIG. 4 illustrates the upper housing 101 with the first half shell 101*a* removed. A membrane or seal 101*f* may be present where the half shells 101*a*, 101*b*, 102*a*, 102*b* are joined together to protect the inner cavities 101*c*, 102*c* from water and other external environmental factors. The membrane or seal 101*f* may be formed of a flexible material such as rubber, foam, or other sealing material. The first half shell 101*a* and the second half shell 101*b* of the upper housing 101 are joined together and form a first inner cavity 101*c*. Within this first inner cavity 101*c* is the communication structure 105, a steering motor 106, and the electrification structure 107.

The steering motor 106 is configured to rotate at least a portion of the communication structure 105. An output shaft 106*a* of the steering motor 106 is connected to a pulley system 106*b*. The pulley system 106*b* is connected to a lower portion of the communication structure 105 at an upper portion of the second support rod 104*a*. The steering motor 106 controls the pulley system 106*b* and therefore rotates the power motor 104. Because both the propeller 104*b* and the rudder 104*c* are connected to the power motor 104, the steering motor 106 rotates these elements in addition to the power motor 104 itself. The steering motor 106 is configured to receive input from the control module 103 via the communication structure 105.

Figure 5:
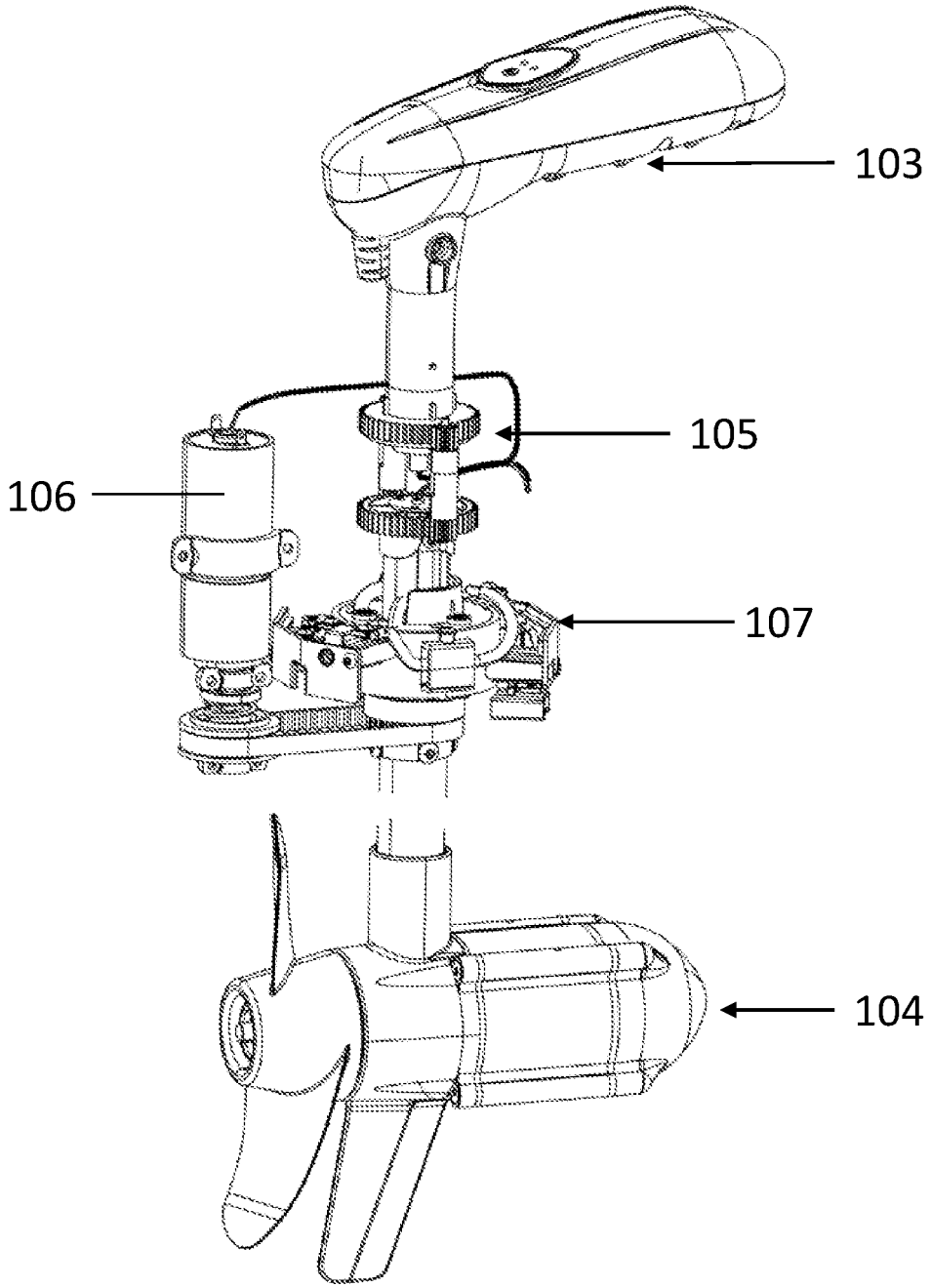
FIG. 5 illustrates a detachable motor assembly after removing a housing.

FIG. 5 illustrates the motor assembly 101 of FIG. 4 after removing the upper housing 101 and the lower housing 102.

Figure 5A:
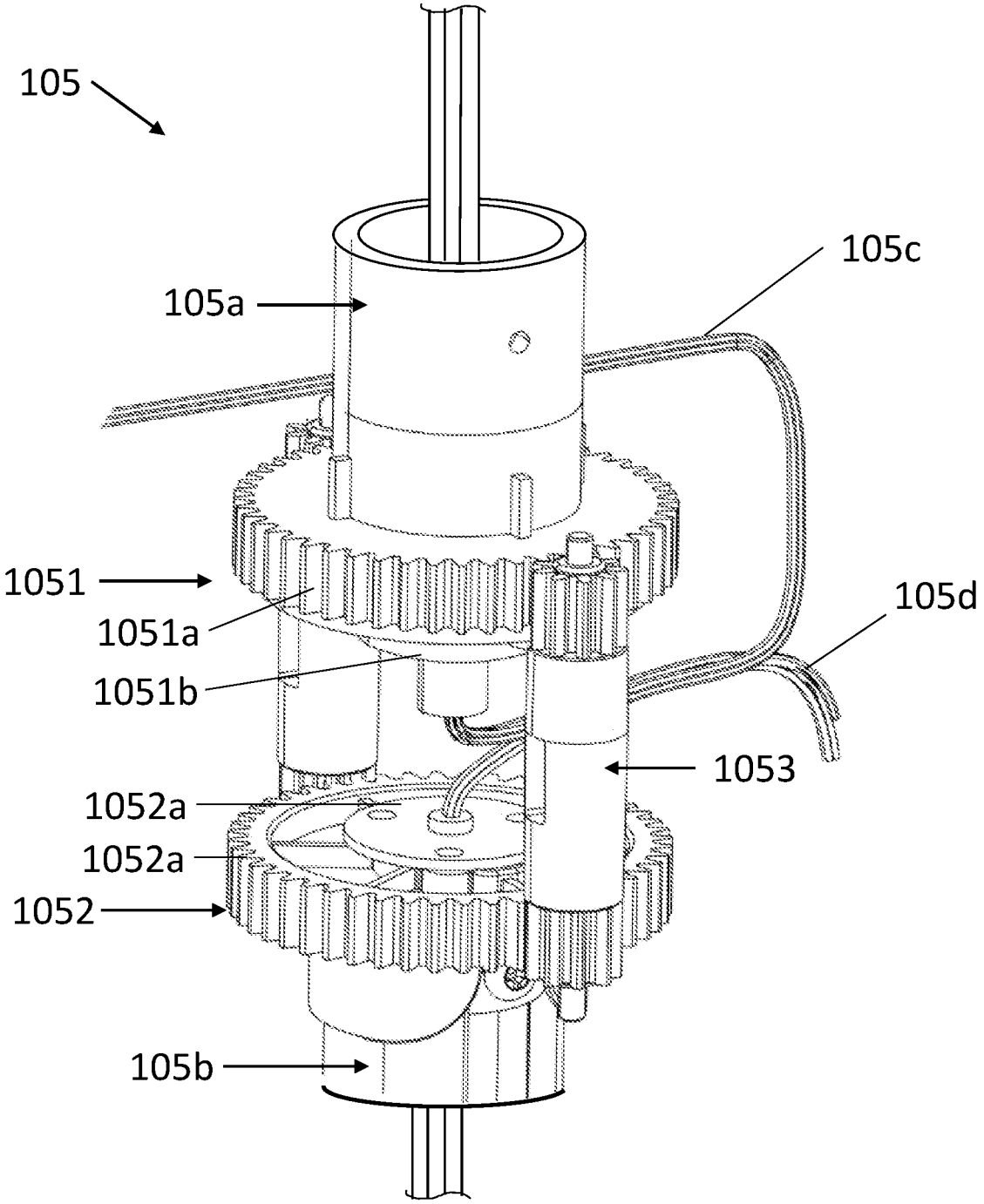
FIG. 5*a* illustrates an enlarged view of the communication structure seen in FIG. 5.

The communication structure 105 as seen in FIG. 5*a*, includes a first pipe 105*a*, a second pipe 105*b*, a first gear transmission assembly 1051, a second gear transmission assembly 1052, and a bridge gear 1053. The first and second hollow pipes 105*a*, 105*b* are preferably machined from a metal such as stainless steel. The first gear transmission assembly 1051 includes a first gear 1051*a* fixed to an end of the first pipe 105*a*. A first slip ring 1051*b* is arranged on the first gear 1051*a*. The second gear transmission assembly 1052 includes a second gear 1052*a* fixed to an end of the second pipe 105*b*. A second slip ring 1052*b* is arranged on the second gear 1052*a*. The first and second slip rings 1051*b*, 1052*b* are preferably electric slip rings. At least one bridge gear 1053 connects the first gear transmission assembly 1051 with the second gear transmission assembly 1052.

A first signal line 105*c*, connected to the first slip ring 1051*b*, connects the control module 103 and the steering motor 106. A second signal line 105*d*, connected to the second slip ring 1052*b*, connects the control module 103 to the power motor 104. The control module 103 can send and receive a variety of signals to each signal line 105*c*, 105*d*. A number of additional signal lines may be present to transmit further functional requirements. Signal commands from the control module 103 are continuously sent to and from the power motor 104 and the steering motor 106. The control module 103 controls a power magnitude of the power motor 104 and therefore the speed of the propeller 104*b*. The control module 103 further controls the steering motor 106 which is configured to rotate the communication structure 105 to thereby rotate the rudder 104*c* and steer the vessel.

Figure 5B:
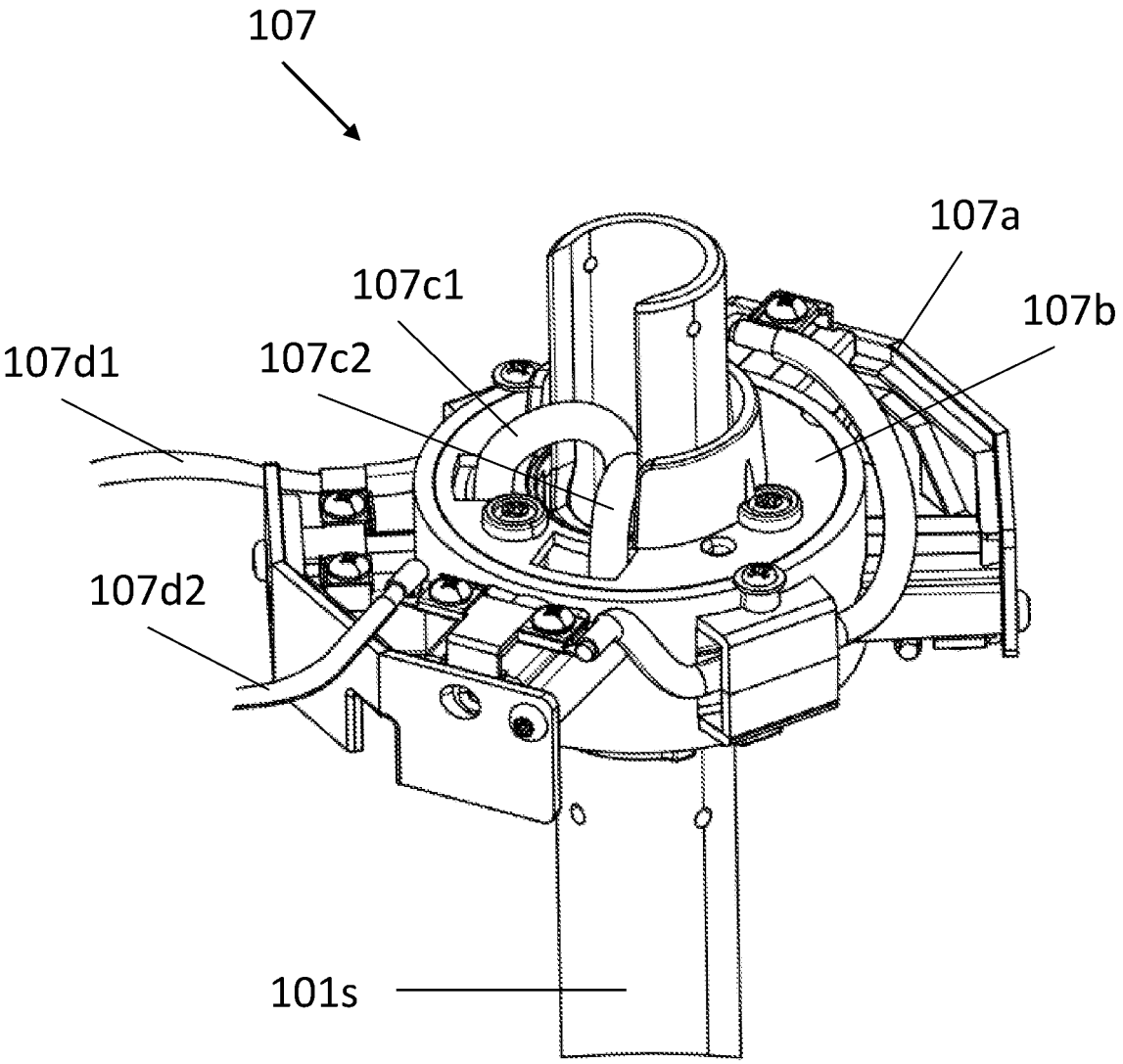
FIG. 5*b* illustrates an enlarged view of the electrification structure seen in FIG. 5.

As seen in FIG. 5*b*, the electrification structure 107 is positioned around the rotatable shaft 101*s*. The electrification structure 107 includes a carbon brush holder 107*a* and a turret 107*b*. The carbon brush holder 107*a* is rotatably attached to the turret 107*b*, and the turret 107*b* is fixed to the rotatable shaft 101*s*. The turret 107*b* can rotate relative to the carbon brush holder 107*a*. The control module 103 and the power motor 104 each have a first power cord 107*c*1, 107*c*2, respectively, extending through a gap in the rotatable shaft 101*s* and into the turret 107*b*. The control module 103 and the power motor 104 also each have a source wire 107*d*1, 107*d*2, respectively. The power cords 107*c*1, 107*c*2 provide power to the control module 103 and the power motor 104, respectively, while the source wires 107*d*1, 107*d*2 each provide data signals to the control module 103 and the power motor 104, respectively.

Figure 5C:
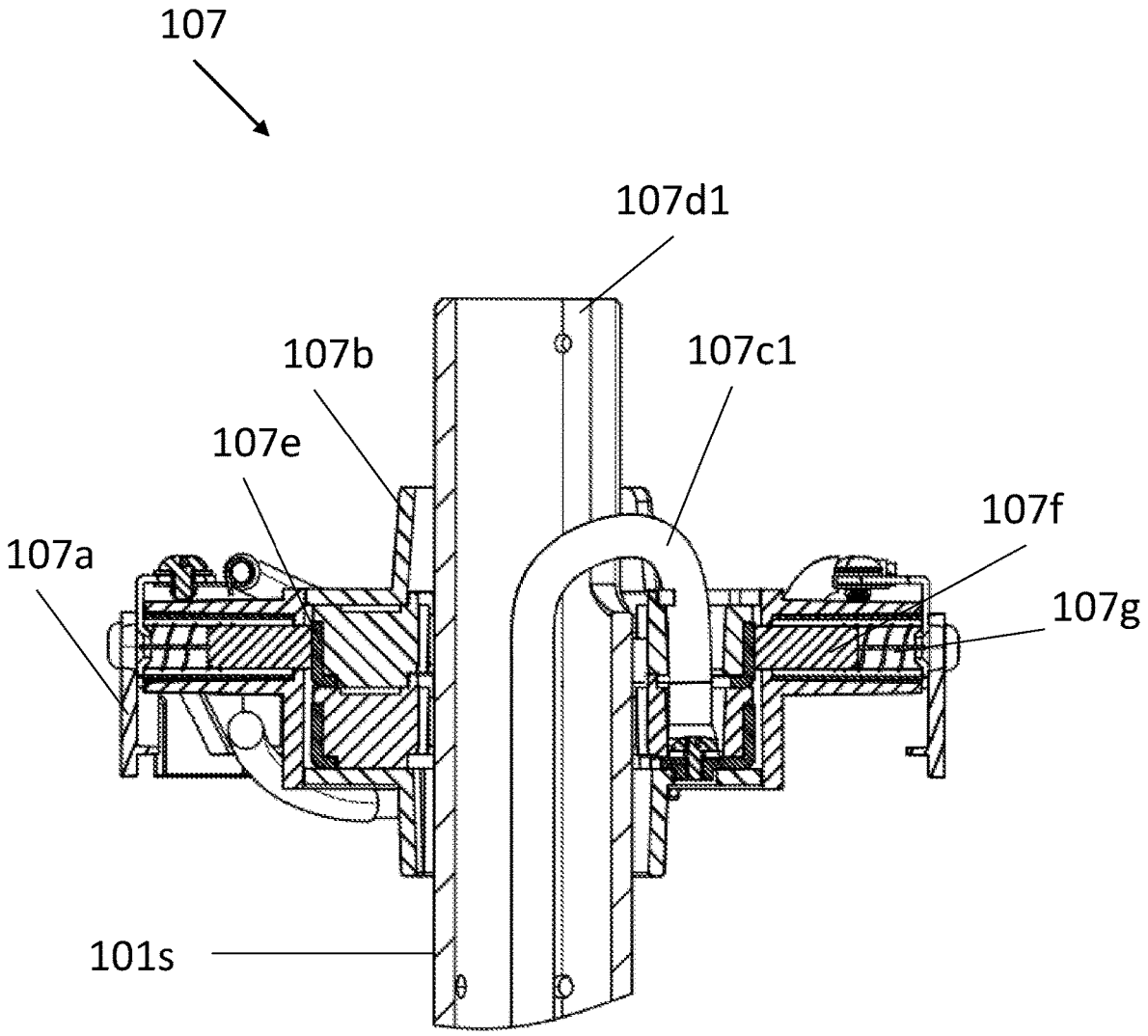
FIG. 5*c* illustrates a section view of the electrification structure seen in FIG. 5*c*.

FIG. 5*c* illustrates a sectional view of the electrification structure 107. At least one conductive ring 107*e* is provided in the turret 107*b*, and the carbon brush holder 107*a* is connected to an external electrical conductor. The power cords 107*c*1, 107*c*2 are connected to the conductive rings 107*e*. A carbon brush 107*f* is held by the carbon brush holder 107*a* and contacts the at least one conductive ring 107*e*. The end of the carbon brush 107*f* not contacting the conductive ring 107*e* is provided with a spring structure 107*g*.

Figure 5D:
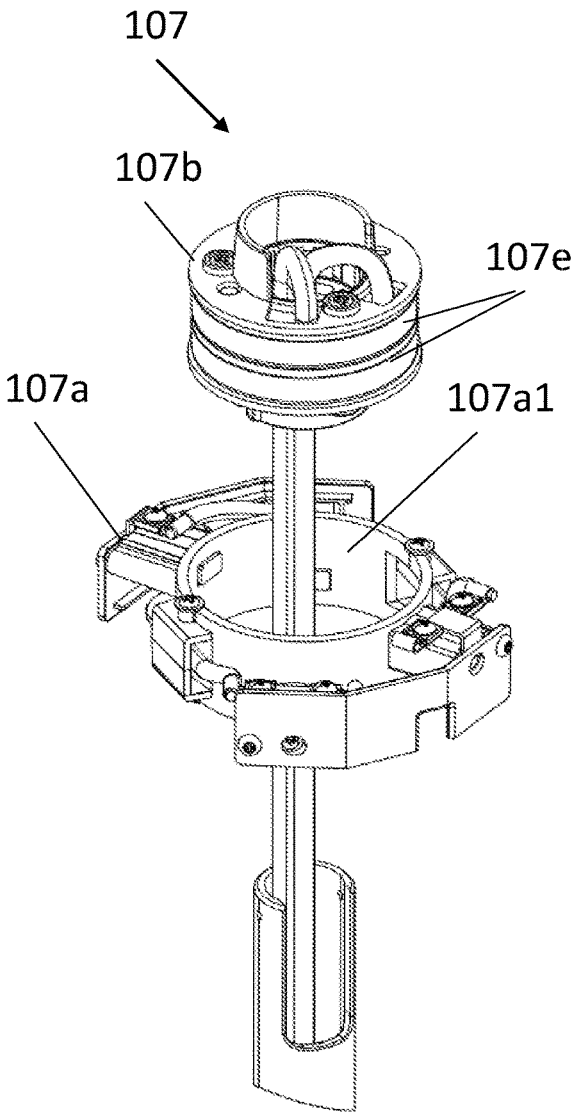
FIG. 5*d* illustrates an exploded view of the electrification structure of FIG. 5*b*.
Figure 5E:
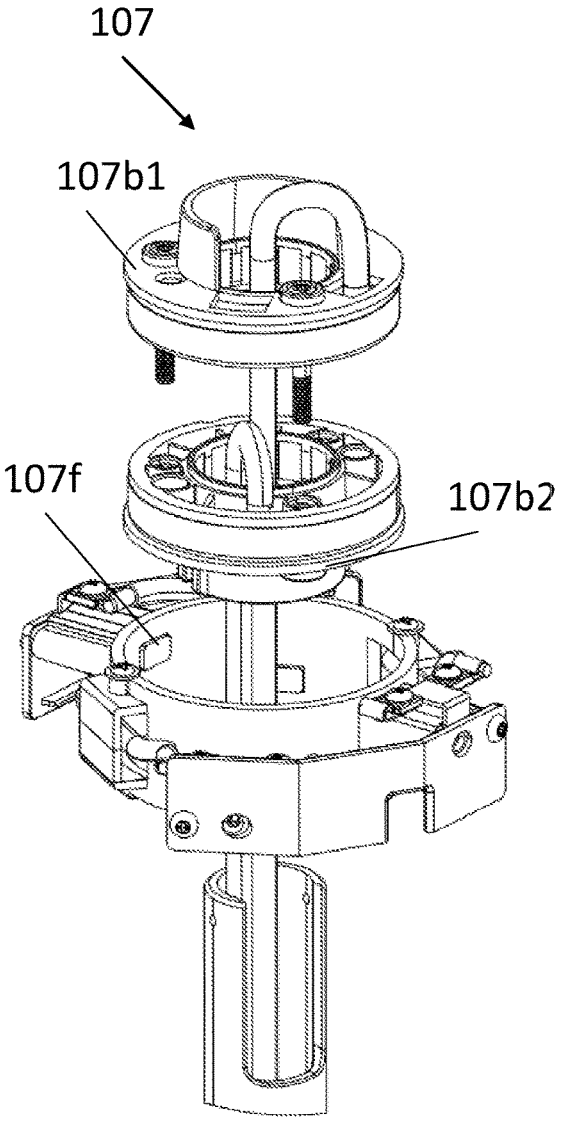
FIG. 5*e* illustrates an exploded view of the electrification structure of FIG. 5*d*.
Figure 5F:
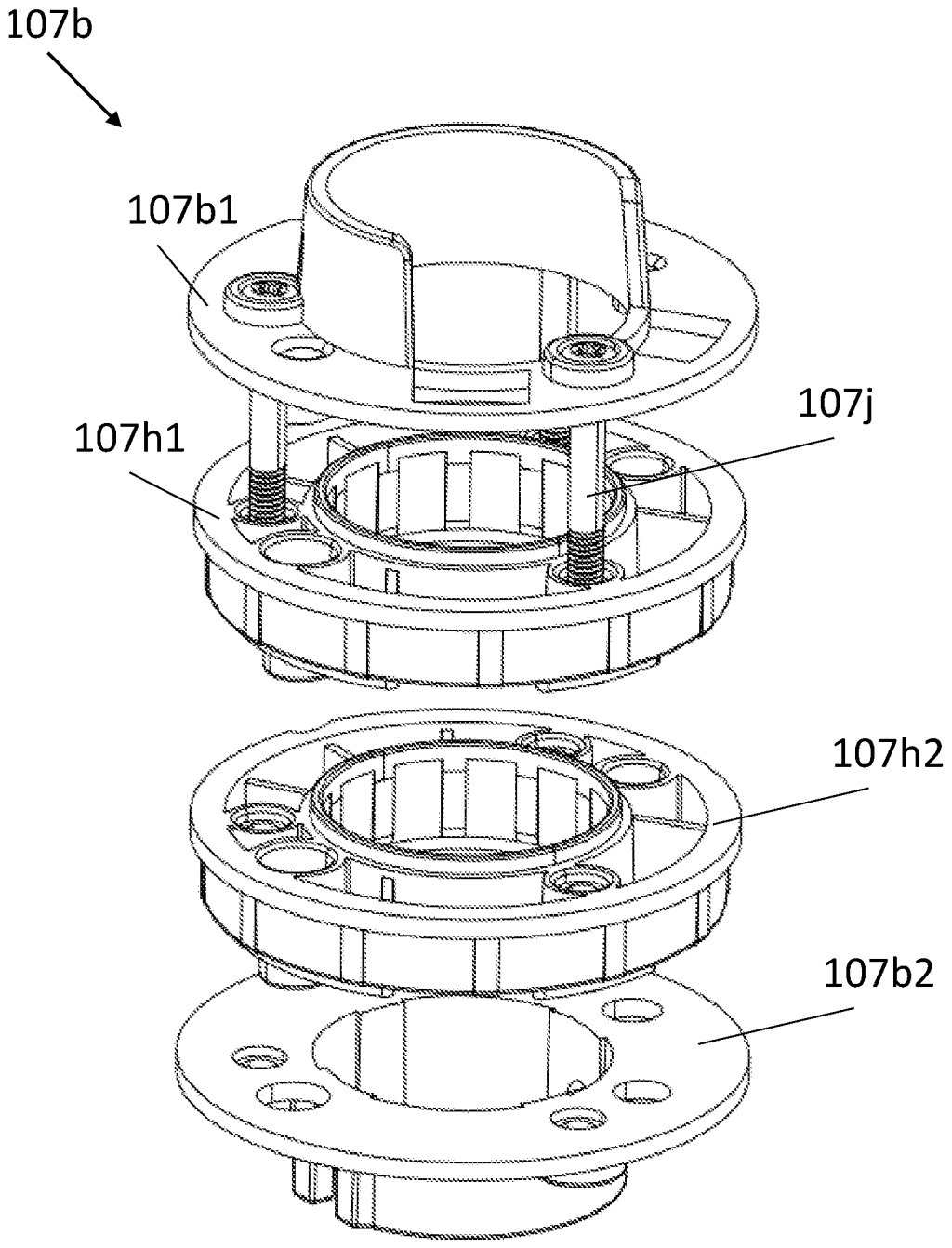
FIG. 5*f* illustrates an exploded view of the coupling seen in FIGS. 5*d* and 5*e*.

FIGS. 5*d* and 5*e* illustrate exploded views of the electrification structure 107. An end of the carbon brush 107*f* extends through an annular wall 107*a*1 of the carbon brush holder 107*a*. The turret 107*b* includes a first fixed plate 107*b*1 and a second fixed plate 107*b*2. As illustrated in FIG. 5*f*, each fixed plate 107*b*1, 107*b*2 includes an electric ring mounting bracket 107*h*1, 107*h*2. The fixed plates 107*b*1, 107*b*1, and the mounting brackets 107*h*1, 107*h*2 are fixed together by bolts 107*j* running from the top of the first fixed plate 107*b*1 to the bottom of the second fixed plate 107*b*2.

Figure 6A:
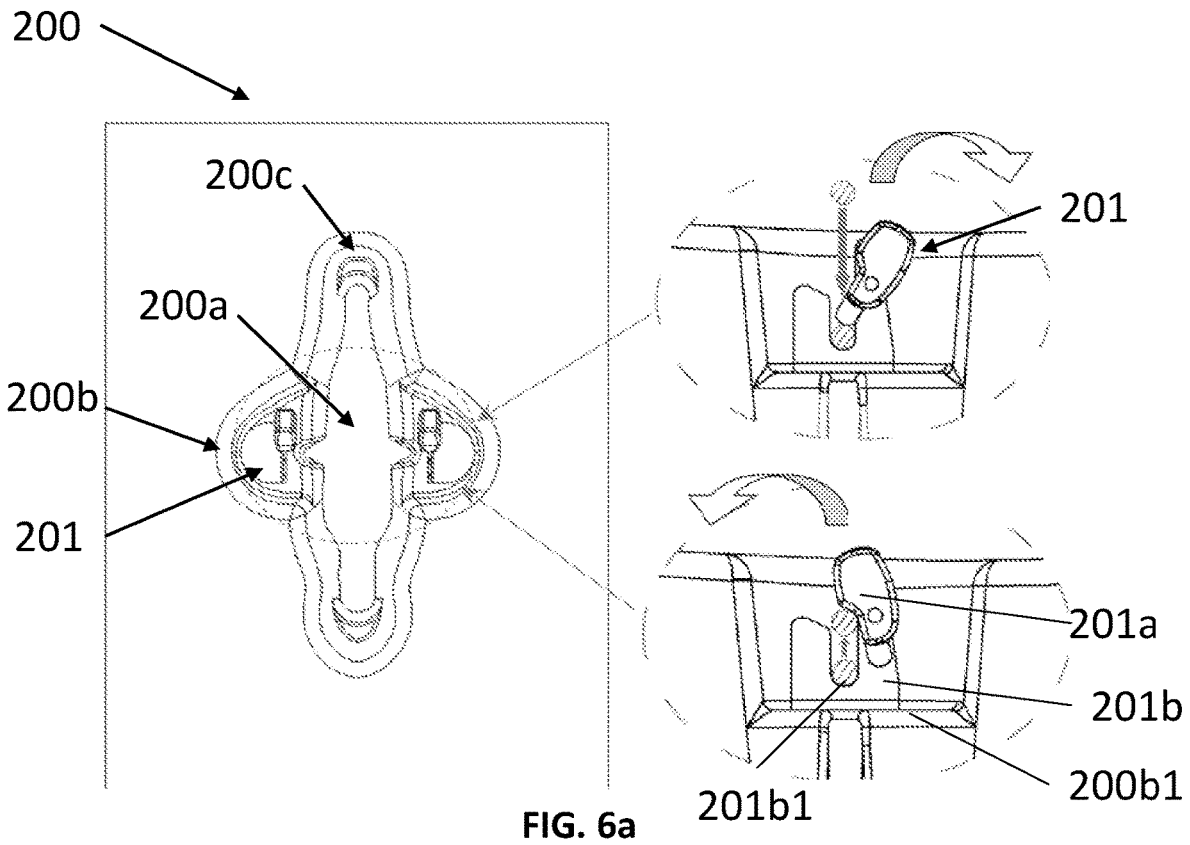
FIG. 6*a* illustrates views of the mounting assembly.
Figure 6B:
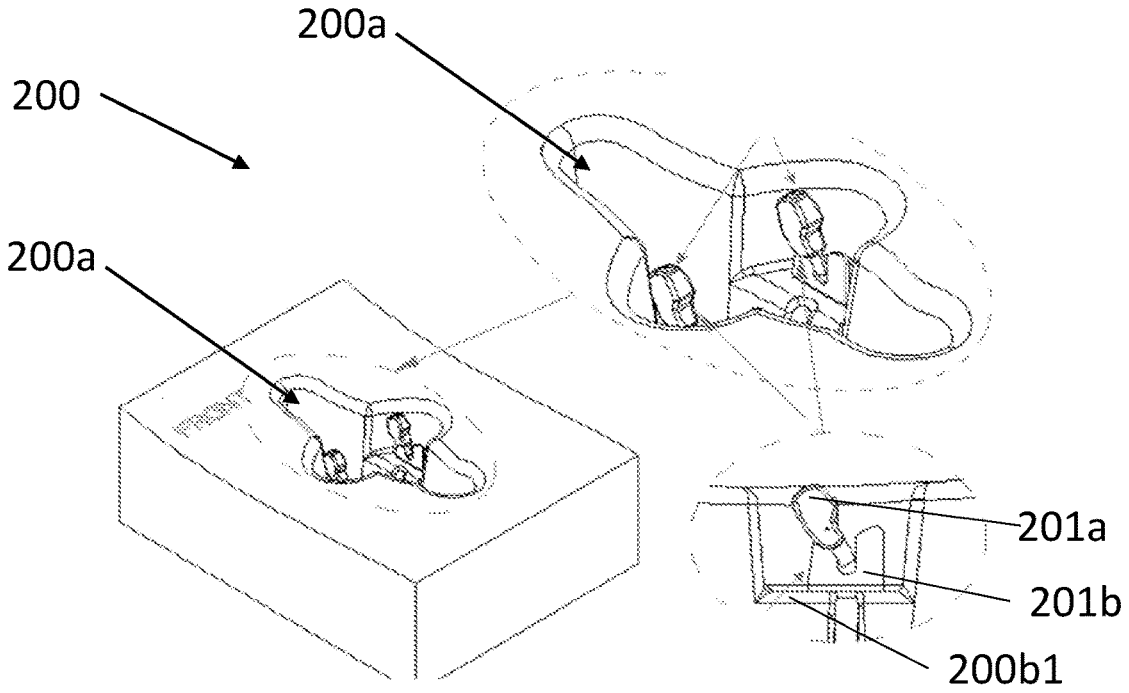
FIG. 6*b* illustrates further views of the mounting assembly.

As seen in FIGS. 6*a* and 6*b*, the mounting assembly 200 includes a cavity 200*a* located within the canoe C. At least a portion of the cavity 200*a* extends all the way through the canoe C. The cavity 200*a* includes two horizontally extending lobes 200*b* and two vertically extending lobes 200*c*. The horizontally extending lobes 200*b* each include a quick-release mechanism 201. The quick-release mechanisms 201 are located on a ledge 200*b*1 within a respective horizontally extending lobe 200*b*. Each quick-release mechanism 201 includes a latch fastener 201*a* and latch base 201*b*. The latch base 201*b* is fixed to the ledge 200*b*1 and contains a slot 201*b*1. The latch fastener 201*a* is pivotably attached to the latch base 201*b*. The latch fastener 201*a* is configured to provide automatic locking of the motor assembly 100 into place. The latch fastener 201*a* requires manual unlocking in order to prevent accidental removal of the motor assembly 100.

The slot 201*b*1 is configured to receive the mounting rod 110 when the motor assembly 100 is lowered into the mounting assembly 200. A lower portion of the latch fastener 201*a* is originally covering a portion of the slot 201*b*1. When the mounting rod 110 is lowered into the slot 201*b*1 and contacts the lower portion of the latch fastener 201*a*, the latch fastener 201*a* rotates in a first direction to allow the mounting rod 110 passage into the slot 201*b*1 past the latch fastener 201*a*. After the mounting rod 110 passes the latch fastener 201*a*, the latch fastener 201*a* returns in a second direction to its original position by way of a return mechanism. The return mechanism may be, for example, a spring. Once the latch fastener 201*a* has returned to its original position, the mounting rod 110 and therefore the motor assembly 100 is locked into place.

In order for the mounting rod 110 and therefore the motor assembly 100 to be removed from the mounting assembly 200, a user rotates the latch fastener 201*a* in the first direction until the lower portion of the latch fastener 201*a* is moved away from the mounting rod 110 and the latch fastener 201*a* is nearly vertical. The user may then grasp the assembly handle 101*h* (FIG. 2) and lift the entire motor assembly 100 out of the mounting assembly 200 and therefore out of the canoe C.

While various features are presented above, it should be understood that the features may be used singly or in any combination thereof. Further, it should be understood that variations and modifications may occur to those skilled in the art to which the claimed examples pertain.

What is claimed is:

1. A motor control assembly and mounting system for a vessel, the system comprising:
- at least one housing;
  - the housing including a control module, a power motor, a steering motor,
  - an electrification structure, and a communication structure; and
- a mounting assembly;
  - wherein the at least one housing is configured to be removably mounted within the mounting assembly;
- wherein the communication structure includes a first signal line and a second signal line;
  - wherein the first signal line extends from the control module to the steering motor through a central portion of the communication structure; and
  - wherein the second signal line extends from the control module to the power motor through the central portion of the communication structure.

2. The system of claim 1, wherein the electrification structure supplies constant electrification to the power motor.

3. The system of claim 1, wherein the housing is comprised of a motor housing and a mounting housing.

4. The system of claim 1, wherein the steering motor is configured to rotate the power motor with a pulley system.

5. The system of claim 1, wherein the mounting assembly is configured to removably mount the motor assembly within a vessel.

6. The system of claim 5, wherein the mounting assembly is configured to automatically lock the motor assembly into place.

7. The system of claim 2, wherein the electrification structure includes at least one conductive ring and a carbon brush.

8. The system of claim 1, wherein the control module and the power motor are mounted on a rotatable shaft.

9. The system of claim 1, wherein the power motor is configured to receive signals from the control module.

10. The system of claim 1, wherein the electrification structure is concentric with the communication structure.

11. The system of claim 1, wherein the communication structure.

12. The system of claim 1, wherein the communication structure includes at least one gear transmission assembly and at least one bridge gear.

13. The system of claim 12, wherein the at least one gear transmission assembly includes a first gear and a first slip ring.

14. The system of claim 13, wherein the first slip ring is an electric slip ring.

15. The system of claim 1, wherein the electrification structure includes a carbon brush holder and a turret.

* * * * *